US011243488B2

(12) United States Patent
Mihara et al.

(10) Patent No.: US 11,243,488 B2
(45) Date of Patent: Feb. 8, 2022

(54) IMAGE FORMING APPARATUS

(71) Applicant: BROTHER KOGYO KABUSHIKI KAISHA, Nagoya (JP)

(72) Inventors: Jun Mihara, Nagoya (JP); Yutaka Kakigahara, Nagoya (JP); Satoshi Murata, Nagoya (JP); Kengo Takeda, Tokai (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/028,142

(22) Filed: Sep. 22, 2020

(65) Prior Publication Data

US 2021/0003949 A1 Jan. 7, 2021

Related U.S. Application Data

(63) Continuation of application No. PCT/JP2018/047486, filed on Dec. 25, 2018.

(30) Foreign Application Priority Data

Mar. 30, 2018 (JP) ..... JP2018-068333

(51) Int. Cl.
*G03G 15/20* (2006.01)
*G03G 15/01* (2006.01)
*G03G 15/00* (2006.01)

(52) U.S. Cl.
CPC ..... *G03G 15/2039* (2013.01); *G03G 15/0131* (2013.01); *G03G 15/2053* (2013.01); *G03G 15/2096* (2013.01); *G03G 15/657* (2013.01)

(58) Field of Classification Search
CPC ..... G03G 15/2039; G03G 15/2053; G03G 15/2096; G03G 15/657
See application file for complete search history.

(56) References Cited

U.S. PATENT DOCUMENTS 5,600,406 A * 2/1997 Aikawa ..... G03G 15/205 399/70
2004/0131402 A1* 7/2004 Kurotori ..... G03G 15/2096 399/340

(Continued)

FOREIGN PATENT DOCUMENTS

JP 7-114290 A 5/1995
JP 2002-351261 A 12/2002

(Continued)

OTHER PUBLICATIONS

Written Opinion issued in corresponding International Patent Application No. PCT/JP2018/047486, dated Feb. 26, 2019.

(Continued)

*Primary Examiner* — Carla J Therrien
(74) *Attorney, Agent, or Firm* — Merchant & Gould P.C.

(57) ABSTRACT

There is provided an image forming apparatus including: a body casing; a toner image forming section including an image carrier and a transferring section; a fixing section; a heater; a temperature sensor; and a controller. In a case that the temperature is higher than a predetermined threshold value, the controller controls the image carrier and the transferring section such that a conveying velocity of the print medium by the image carrier and the transferring section becomes a first conveying velocity. In a case that the temperature is lower than the predetermined threshold value, the controller controls the image carrier and the transferring section such that the conveying velocity of the print medium by the image carrier and the transferring section becomes a second conveying velocity slower than the first conveying velocity.

12 Claims, 3 Drawing Sheets

(56) References Cited

U.S. PATENT DOCUMENTS

| | | | | |
|---|---|---|---|---|
| 2007/0196146 | A1 | 8/2007 | Tanaka et al. | |
| 2007/0231027 | A1 | 10/2007 | Kamei et al. | |
| 2009/0067868 | A1 | 3/2009 | Arizumi et al. | |
| 2009/0324309 | A1* | 12/2009 | Nakamura ..... | G03G 15/2096 399/340 |
| 2011/0275015 | A1* | 11/2011 | Nagao ..... | G03G 15/2096 430/30 |
| 2012/0070161 | A1* | 3/2012 | Yashiro ..... | G03G 15/2039 399/24 |
| 2014/0119796 | A1 | 5/2014 | Priebe et al. | |
| 2018/0217543 | A1 | 8/2018 | Kakigahara et al. | |

FOREIGN PATENT DOCUMENTS

| | | | |
|---|---|---|---|
| JP | 2002-372888 | A | 12/2002 |
| JP | 2004-109747 | A | 4/2004 |
| JP | 2004-284306 | A | 10/2004 |
| JP | 2005-121771 | A | 5/2005 |
| JP | 2006-337722 | A | 12/2006 |
| JP | 2007-225730 | A | 9/2007 |
| JP | 2007-279160 | A | 10/2007 |
| JP | 2010-122397 | A | 6/2010 |
| JP | 2012-3168 | A | 1/2012 |
| JP | 2012-93510 | A | 5/2012 |
| JP | 2012-128260 | A | 7/2012 |
| JP | 2016-80789 | A | 5/2016 |
| JP | 2017-68098 | A | 4/2017 |
| JP | 2017-116783 | A | 6/2017 |

OTHER PUBLICATIONS

International Search Report issued in corresponding International Patent Application No. PCT/JP2018/047486, dated Feb. 26, 2019.
Notice of Reasons for Refusal received in related foreign application JP 2018-068333, dated Nov. 30, 2021.
Partial Supplementary European Search Report issued in corresponding European Patent Application No. 18912956.2 dated Nov. 30, 2021.

* cited by examiner

IMAGE FORMING APPARATUS

CROSS-REFERENCE

This application is a U.S. national phase entry of International Application No. PCT/JP2018/047486 filed on Dec. 25, 2018 which claims priority from Japanese patent Application No. 2018-068333 filed on Mar. 30, 2018. The disclosures of International Application No. PCT/JP2018/047486 and Japanese patent Application No. 2018-068333 are incorporated herein by reference in their entirety.

TECHNICAL FIELD

The present disclosures relate to an image forming apparatus.

BACKGROUND ART

Conventionally, an image forming apparatus is provided with a fixing section which is configured to fix a toner image to a print medium. The fixing section sprays a fixing solution onto the print medium in which the toner image is formed so as to fix the toner image to the print medium.

SUMMARY

In the publicly-known image forming apparatus as described above, the fixing property of the toner image with respect to the print medium is lowered, in some cases, by a temperature of the environment in which the image forming apparatus is installed.

In view of this situation, an object of the present disclosure is to provide an image forming apparatus capable of suppressing any lowering in the fixing property of the toner image with respect to the print medium due to the temperature of environments in which the image forming apparatus is installed.

(1) An image forming apparatus of the present disclosure includes: a body casing, a toner image forming section, a fixing section, a heater, a temperature sensor, and a controller. The toner image forming section is configured to form a toner image onto a print medium. The toner image forming section has an image carrier and a transferring section. The transferring section is configured to transfer the toner image formed on a surface of the image carrier to the print medium. The transferring section is configured to convey the print medium together with the image carrier. The fixing section is configured to apply a fixing solution to the print medium conveyed by the image carrier and the transferring section such that the toner image is fixed onto the print medium. The heater is configured to heat the print medium having passed the fixing section. The temperature sensor is configured to measure a temperature in the body casing. The controller is configured to control the image carrier and the transferring section. In a case that the temperature measured by the temperature sensor is higher than a predetermined threshold value, the controller is configured to control the image carrier and the transferring section such that a conveying velocity of the print medium by the image carrier and the transferring section becomes a first conveying velocity. Further, in a case that the temperature measured by the temperature sensor is lower than the predetermined threshold value, the controller is configured to control the image carrier and the transferring section such that the conveying velocity of the print medium by the image carrier and the transferring section becomes a second conveying velocity which is slower than the first conveying velocity.

According to such a configuration, by slowing down the conveying velocity of the print medium by the image carrier and the transferring section, it is possible to lengthen a period of time during which the print medium having the fixing solution applied thereto passes (passes through) the heater.

With this, it is possible to secure a long period of time for fixing the toner image to the print medium in a case that the temperature is lower than the threshold value.

As a result, it is possible to suppress any lowering in the fixing property of the toner image with respect to the print medium due to the temperature of the environment in which the image forming apparatus is installed.

(2) The temperature sensor may be configured to measure a temperature in the vicinity of the fixing section.

(3) The temperature sensor may be configured to measure a temperature in a space between the transferring section and the fixing section.

(4) The threshold value may be in a range of not less than 0° C. to not more than 10° C.

(5) The second conveying velocity may be in a range of not less than ¼ times to not more than ½ times the first conveying velocity.

(6) The image forming apparatus may further include a conveyor. The conveyor is configured to convey the print medium having passed the fixing section. In the case that the temperature measured by the temperature sensor is higher than the predetermined threshold value, the controller is configured to control the conveyor such that a conveying velocity of the print medium by the conveyor becomes a first velocity. Further, in the case that the temperature measured by the temperature sensor is lower than the predetermined threshold value, the controller is configured to control the conveyor such that the conveying velocity of the print medium by the conveyor becomes a second velocity slower than the first velocity.

(7) The heater may be positioned between the fixing section and the conveyor.

(8) The controller may be configured to control a heating temperature of the heater in accordance with the temperature measured by the temperature sensor.

(9) In the case that the temperature measured by the temperature sensor is higher than the predetermined threshold value, the controller may be configured to control the heater such that the heating temperature of the heater becomes a first heating temperature. Further, in the case that the temperature measured by the temperature sensor is lower than the predetermined threshold value, the controller may be configured to control the heater such that the heating temperature of the heater becomes a second heating temperature higher than the first heating temperature.

(10) The controller may be configured to control an application amount of the fixing solution to be applied by the fixing section, in accordance with an image quality of the toner image. Further, the controller may be configured to control the heating temperature of the heater in accordance with the application amount of the fixing solution to be applied by the fixing section.

(11) The heater may make no contact with the print medium in a case that the heater heats the print medium.

(12) The image forming apparatus may include a driving source configured to drive the conveyor. The driving source may be configured to drive the image carrier and the transferring section.

(13) An image forming apparatus may include a body casing, a toner image forming section, a fixing section, a heater, and a controller. The toner image forming section is configured to form a toner image onto a print medium. The fixing section is configured to apply a fixing solution to the toner image such that the toner image is fixed onto the print medium. The heater is configured to heat the print medium having passed the fixing section. The controller is configured to control an application amount of the fixing solution to be applied by the fixing section, in accordance with an image quality of the toner image. Further, the controller is configured to control a heating temperature of the heater in accordance with the application amount of the fixing solution to be applied by the fixing section.

(14) An image forming apparatus may include a body casing, a toner image forming section, a fixing section, a conveyor, a temperature sensor, and a controller. The toner image forming section is configured to form a toner image onto a print medium. The fixing section is configured to apply a fixing solution to the toner image such that the toner image is fixed onto the print medium. The conveyor is configured to convey the print medium having passed the fixing section. The temperature sensor is configured to measure a temperature in the body casing. The controller is configured to control the conveyor. In a case that the temperature measured by the temperature sensor is higher than a predetermined threshold value, the controller is configured to control the conveyor such that a conveying velocity of the print medium becomes a first velocity. Further, in a case that the temperature measured by the temperature sensor is lower than the predetermined threshold value, the controller is configured to control the conveyor such that the conveying velocity of the print medium becomes a second velocity slower than the first velocity.

According to the image forming apparatus of the present disclosure, it is possible to suppress the lowering in the fixing property of the toner image with respect to the print medium due to the temperature of the environment in which the image forming apparatus is installed.

DESCRIPTION OF THE EMBODIMENT

Figure 1:
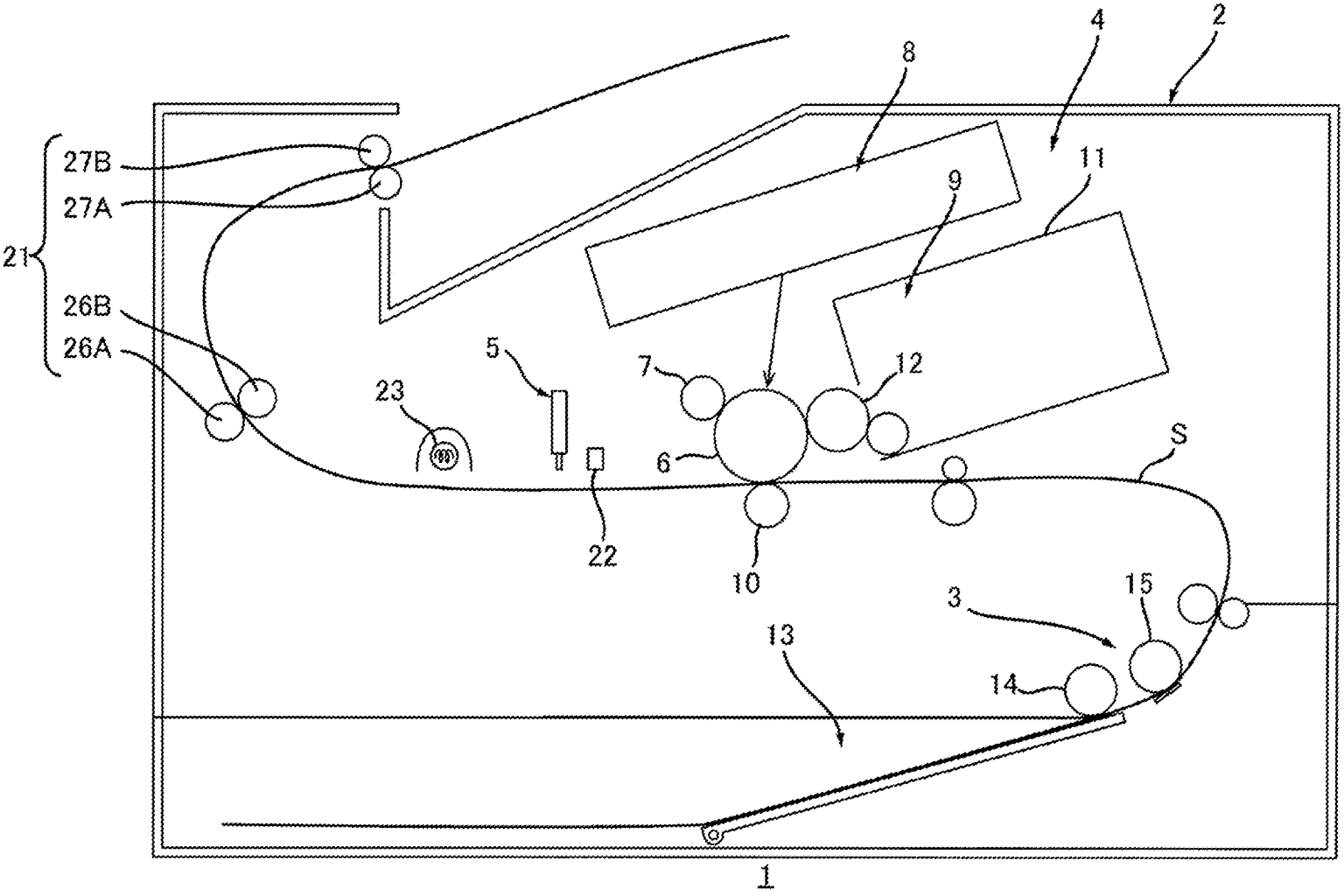
FIG. 1 is a view depicting the schematic configuration of an image forming apparatus.

1. Overall Schematic of Image Forming Apparatus

The overall schematic of an image forming apparatus 1 will be explained, with reference to FIG. 1.

The image forming apparatus 1 includes a body casing (main body casing) 2, a sheet feeding section 3, a toner image forming section 4, and a fixing section 5.

1.1 Body Casing

The body casing 2 constructs the exterior of the image forming apparatus 1. The body casing 2 accommodates the sheet feeding section 3, the toner image forming section 4, and the fixing section 5.

1.2: Sheet Feeding Section

The sheet feeding section 3 is configured to supply or feed a print medium S to the toner image forming section 4. Specifically, the sheet feeding section 3 is configured to convey the print medium S toward an image carrier 6 of the toner image forming section 4. The toner image forming section 4 will be explained later on. The sheet feeding section 3 includes a paper feed tray 13, a pick-up roller 14, and a paper feed roller 15. The paper feed tray 13 is configured to accommodate the print medium S. The print medium S is, for example, printing paper (printing paper sheet, printing sheet). The pick-up roller 14 is configured to convey the print medium S in the inside of the paper feed tray 13 toward the paper feed roller 15. The paper feed roller 15 is configured to convey the print medium S from the pick-up roller 14 toward the image carrier 6.

1.3: Toner Image Forming Section

The toner image forming section 4 is configured to use a toner to thereby form a toner image in the print medium S. The toner image forming section 4 includes an image carrier 6, a charger 7, an exposure device 8, a developing device 9, and a transferring section 10.

The image carrier 6 is configured to carry the toner image. Specifically, the image carrier 6 is a photosensitive drum.

The charger 7 is configured to charge a surface of the image carrier 6. The charger 7 is specifically a charging roller. Note that the charger 7 may be a scorotron type charging device. In a case that the charger 7 is the charging roller, the charger 7 makes contact with the surface of the image carrier 6. In a case that the charger 7 is the scorotron type charging device, the charger 7 is positioned to be separated away from the surface of the image carrier 6 at a spacing distance.

The exposure device 8 is configured to expose the surface of the image carrier 6. More specifically, the exposure device 8 is configured to expose the surface of the image carrier 6 charged by the charger 7. As a result, an electrostatic latent image is formed on the surface of the image carrier 6. The exposure device 8 is specifically a laser scan unit. Note that the exposure device 8 may be an LED array.

The developing device 9 is configured to supply or feed the toner onto the surface of the image carrier 6. As a result, the electrostatic latent image is developed, and a toner image is formed on the surface of the image carrier 6. The developing device 9 includes a toner accommodating section 11 and a developing roller 12.

The toner accommodating section 11 accommodates the toner. The toner contains toner particles, and as necessary or optionally, an external additive. The toner particles contain: a binder resin, and as necessary, a colorant, a pigment dispersant, a mold releasing agent, a magnetic body, and an electrostatic charge controlling agent. The binder resin is the base of the toner particles. The binder resin binds components contained in the toner particles. The binder resin is softened by the application of the fixing solution thereto, and then is cured so that the binder is firmly fixed to the print medium S. The colorant imparts a desired color to the toner particles. The colorant is dispersed in the binder resin. The pigment dispersant improves the dispersibility of the colorant. The electrostatic charge controlling agent imparts the electrostatic property to the toner particles. The electrostatic property may be either of the positive electrostatic charge or of the negative electrostatic charge. The external additive adjusts the electrostatic property, the fluidity, the storage stability of the toner particles.

The developing roller 12 is configured to supply the toner inside the toner accommodating section 11 to the surface of the image carrier 6. The developing roller 12 makes contact with the image carrier 6. Note that it is allowable that the developing roller 12 makes no contact with the image carrier 6.

The developing device 9 may be configured as a single process unit, together with the image carrier 6 and the charger 7. The process unit may be installable with respect to the body casing 2.

Further, the developing device 9 may be a developing cartridge which is installable with respect to a drum unit having the image carrier 6 and the charger 7. The drum unit may be installable with respect to the body casing 2.

Further, the developing device 9 may include a developer which includes the developing roller 12, and a toner cartridge which is installable with respect to the developer. In such a case, the toner cartridge is provided with the toner accommodating section 11. Further, the developer may be provided on the drum unit. The developer may be installable with respect to the drum unit.

The transferring section 10 is configured to transfer the toner image formed on the surface of the image carrier 6 to the print medium S. Further, the transferring section 10 is configured to convey, together with the image carrier 6, the print medium S. Specifically, the transferring section 10 is a transfer roller. The transferring section 10 makes contact with the image carrier 6. Note that it is allowable that the transferring section 10 makes no contact with image carrier 6. Further note that the transferring section 10 may be, for example, a transfer belt.

1.4: Fixing Section

The fixing section 5 applies the fixing solution to the print medium S, conveyed by the image carrier 6 and the transferring section 10, so as to fix the toner image to the print medium S. In other words, the fixing solution is applied to the print medium S, in which the toner image is formed by the toner image forming section 4, so as to fix the toner image to the print medium S. Specifically, the fixing section 5 is a fixing device which sprays the fixing solution by electrostatic spraying. Note that the fixing section 5 may be a fixing device having a fixing roller configured to apply the fixing solution, or a fixing device having a piezoelectric device configured to apply the fixing solution. The print medium S which has passed the fixing section 5 is discharged, by the conveyor 21, to the upper surface of the body casing 2. The conveyor 21 will be explained later.

2. Details of Image Forming Apparatus

Figure 2:
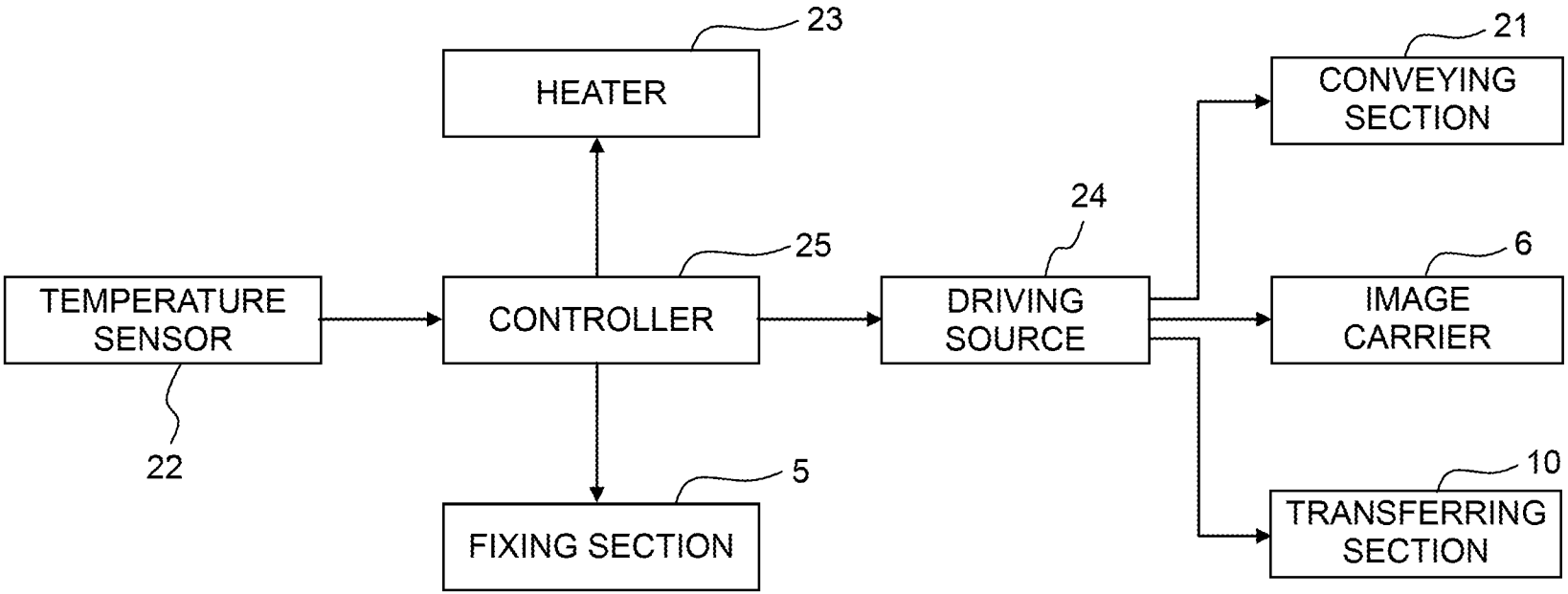
FIG. 2 is a block diagram for explaining the electrical connection among respective parts, sections and/or components of, and the transmission of the power (motive power) in the image forming apparatus depicted in FIG. 1.

As depicted in FIGS. 1 and 2, the image forming apparatus 1 further includes a conveyor 21, a temperature sensor 22, a heater 23, a driving source 24 (see FIG. 2), and a controller 25 (see FIG. 2).

2.1: Conveyor

As depicted in FIG. 1, the conveyor 21 conveys the print medium S which has passed the fixing section 5. Specifically, the conveyor 21 includes a plurality of conveying rollers 26A, 26B, and a plurality of discharge rollers 27A, 27B.

The conveying roller 26A conveys, together with the conveying roller 26B, the print medium S which has passed the fixing section 5 toward the discharge roller 27A. The conveying roller 26A makes contact with the conveying roller 26B. The print medium S passes between the conveying roller 26A and the conveying roller 26B.

The discharge roller 27A discharges, together with the discharge roller 27B, the print medium S that has passed between the conveying roller 26A and the conveying roller 26B to the outside of the body casing 2. The discharge roller 27A makes contact with the discharge roller 27B. The print medium S passes between the discharge roller 27A and the discharge roller 27B.

2.2: Temperature Sensor

The temperature sensor 22 measures a temperature in (inside, in the inside of) the body casing 2. Specifically, the temperature sensor 22 measures a temperature in the vicinity of the fixing section 5. More specifically, the temperature sensor 22 measures a temperature in a space between the transferring section 10 and the fixing section 5.

2.3: Heater

The heater 23 heats the print medium S which has passed the fixing section 5. The heater 23 is positioned between the fixing section 5 and the conveyor 21. The heater 23 does not have any contact with the print medium S in a case that the heater heats the print medium S. Specifically, the heater 23 is a halogen lamp. Note that the heater 23 may be a roller which makes contact with the print medium S.

2.4: Driving Source

As depicted in FIG. 2, the driving source 24 drives the conveyor 21, the image carrier 6 and the transferring section 10. Specifically, the driving source 24 is a motor. In a case that the driving source 24 is a motor, the driving source 24 is connected to the plurality of conveying rollers 26A, 26B and the plurality of the discharge rollers 27A, 27B of the conveyor 21, the image carrier 6, and the transferring section 10 via a power transmission mechanism (not depicted in the drawings). The power transmission mechanism (not depicted in the drawings) may include a gear train and/or a clutch. Thus, the motive power from the driving source 24 is transmitted to the plurality of the conveying roller 26A and 26B and the plurality of the discharge rollers 27A and 27B of the conveyor 21, the image carrier 6, and the transferring section 10 via the gear train (not depicted in the drawings).

2.5: Controller

As depicted in FIG. 2, the controller 25 controls the temperature sensor 22, the fixing section 5, the heater 23, the driving source 24, and the power transmitting mechanism (which is not depicted in the drawings). Further, the controller 25 controls the driving source 24 or the power transmitting mechanism (not depicted in the drawings) to thereby control the conveyor 21, the image carrier 6, and the transferring section 10. The controller 25 is electrically connected to the temperature sensor 22, the fixing section 5, the heater 23, the driving source 24, and the power transmitting mechanism (which is not depicted in the drawings), via a signal trace (which is not depicted in the drawings). The controller 25 may be, for example, a control circuit board provided with a memory and an ASIC. Alternatively, the controller 25 may be a control circuit board provided with a memory and a CPU.

3. Fixing Control of Image Forming Apparatus

Next, the fixing control of the image forming apparatus 1 will be explained, with reference to FIG. 3.

Figure 3:
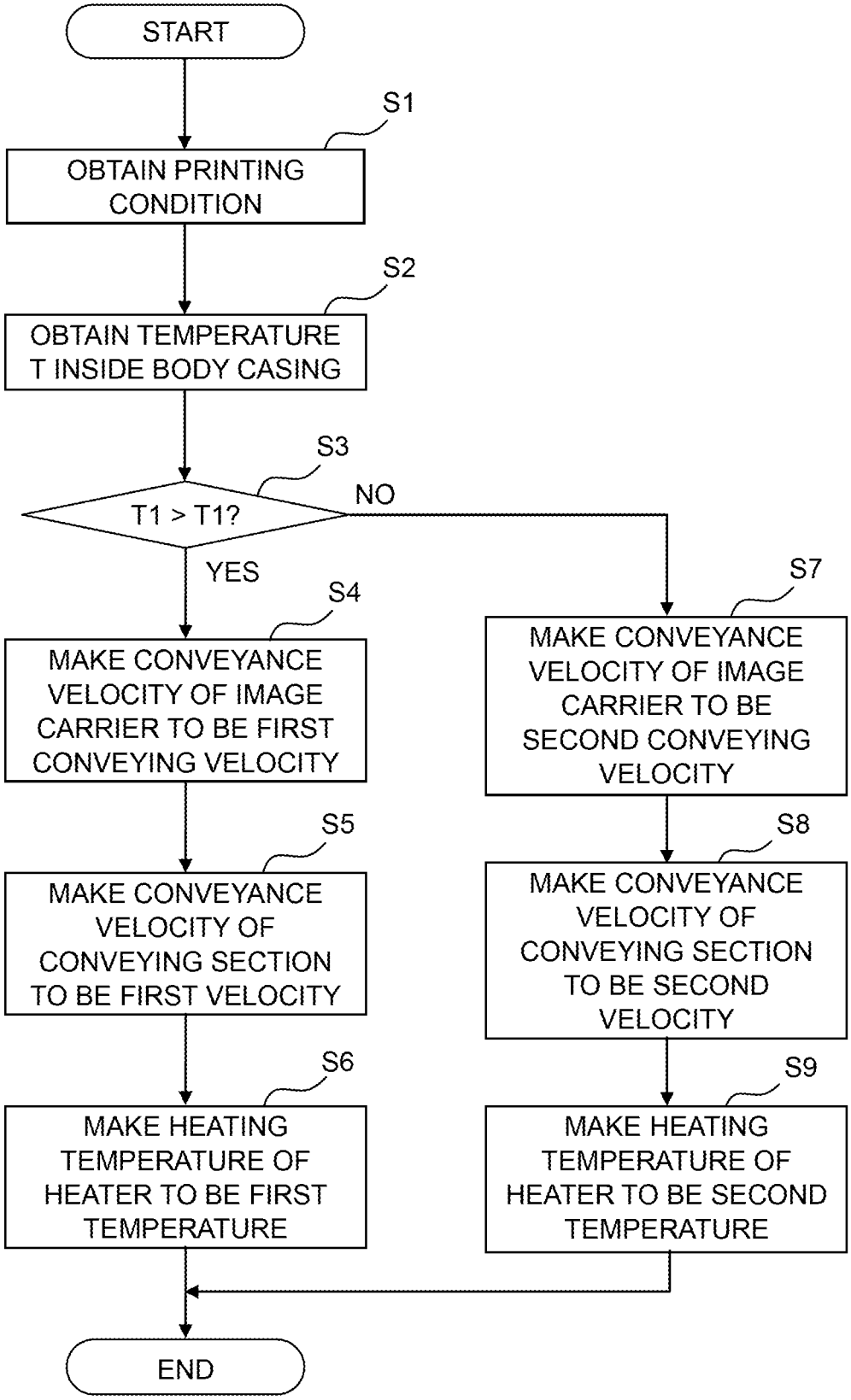
FIG. 3 is a flowchart for explaining the fixing control of the image forming apparatus depicted in FIG. 1.

As depicted in FIG. 3, the controller 25 controls a conveying velocity (S4) of the print medium S by the conveyor 21, a conveying velocity (S5) of the print medium S by the image carrier 6 and the transferring section 10, and a heating temperature (S6) of the heater 23, based on a printing condition (S1) and a temperature (S2) in the body casing 2 so as to optimize a fixing condition.

The above-described control performed by the controller 25 will be explained in detail as below.

3.1: Obtainment of Printing Condition and Obtainment of Temperature Inside Body Casing In a case that a print job is inputted to the image forming apparatus, the controller 25 obtains a printing condition of the print job (step S1). The printing condition is exemplified, for example, by: the kind of the print medium S, the image quality of the toner image, the number of sheets (paper sheets) on which the printing is to be performed, etc.

Note that the controller 25 may control an application amount of the fixing solution to be applied by the fixing section 5 and a heating temperature of the heater 23, based on the printing condition. Specifically, the controller 25 has data of coefficients corresponding to the respective kinds of the printing condition which are the kind of the print medium S, the image quality of the toner image, the number of sheets to which the printing is to be performed, etc. More specifically, a memory of the controller 25 has the data of coefficients corresponding to the respective kinds of the printing condition which are the kind of the print medium S, the image quality of the toner image, the number of sheets to which the printing is to be performed, etc. The controller 25 controls the application amount of the fixing solution, in accordance with the printing condition, by multiplying a reference value of the application amount of the fixing solution by a coefficient based on the printing condition. Further, the controller 25 controls the heating temperature of the heater 23, in accordance with the printing condition, by multiplying a reference value of the heating temperature of the heater 23 by a coefficient based on the printing condition. Specifically, the ASIC or the CPU of the controller 25 controls the application amount of the fixing solution in accordance with the printing condition by multiplying the reference value of the application amount of the fixing solution stored in the memory of the controller 25 by the coefficient based on the printing condition stored in the memory of the controller 25. Furthermore, the ASIC or the CPU of the controller 25 controls the heating temperature of the heater 23 in accordance with the printing condition by multiplying the reference value of the heating temperature of the heater 23 stored in the memory of the controller 25 by the coefficient based on the printing condition stored in the memory of the controller 25.

More specifically, the controller 25 controls the application amount of the fixing solution to be applied by the fixing section 5 in accordance with the image quality of the toner image. Further, the controller 25 controls the heating temperature of the heater 23 in accordance with the application amount of the fixing solution to be applied by the fixing section 5. Specifically, in a case that the image quality of the toner image is a high image quality, the controller 25 controls the fixing section 5 so that the application amount of the fixing solution to be applied by the fixing section 5 is increased. Further, in a case that the controller 25 increases the application amount of the fixing solution to be applied by the fixing section 5, the controller 25 controls the heater 23 so that the heating temperature of the heater 23 is raised to be high. Furthermore, in a case that the image quality of the toner image is a low image quality, the controller 25 controls the fixing section 5 so that the application amount of the fixing solution to be applied by the fixing section 5 is reduced to be small. Moreover, in a case that the controller 25 reduces the application amount of the fixing solution to be applied by the fixing section 5, the controller 25 controls the heater 23 so that the heating temperature of the heater 23 is lowered.

Further, the controller 25 obtains a temperature T measured by the temperature sensor 22 (step S2).

3.2: Determining Processing

Next, the controller 25 determines whether or not the temperature T is higher than a threshold value T1 (step S3).

The threshold value T1 is, for example, in a range of not less than 0° C. to not more than 10° C. Specifically, the threshold value T1 is 10° C.

3.3: In a Case that Temperature Inside Casing is Higher than Threshold Value

In a case that the temperature T is higher than the threshold value T (step S3: YES), the controller 25 controls the image carrier 6 and the transferring section 10 so as to make the conveying velocity of the print medium S by the image carrier 6 and the transferring section 10 to be a first conveying velocity (step S4).

Further, in the case that the temperature T is higher than the threshold value T1 (step S3: YES), the controller 25 controls the conveyor 21 so as to make the conveying velocity of the print medium S by the conveyor 21 to be a first velocity (step S5).

It is preferred that the first velocity is a velocity same as the first conveying velocity. Specifically, the controller 25 controls the rotation rate (number of rotations) of the driving source 24 to thereby make the conveying velocity of the print medium S by the image carrier 6 and the transferring section 10 to be the first conveying velocity and to thereby make the conveying velocity of the print medium S by the conveyor 21 to be the first velocity.

Further, the controller 25 controls the heating temperature of the heater 23, in accordance with the temperature T. Specifically, in the case that the temperature T is higher than the threshold value T1 (step S3: YES), the controller 25 controls the heater 23 so as to make the heating temperature of the heater 23 to be a first heating temperature (step S6).

The first heating temperature is, for example, in a range of not less than 40° C. to not more than 90° C. It is preferred that the first heating temperature is in a range of not less than 50° C. to not more than 70° C.

Afterwards, the controller 25 executes the printing at the first conveying velocity, the first velocity, and the first heating temperature.

3.4: In a Case that Temperature Inside Body Casing is Lower than Threshold Value On the other hand, in a case that the temperature T is lower than the threshold value T1 (step S3: NO), the controller 25 controls the image carrier 6 and the transferring section 10 so as to make the conveying velocity of the print medium S by the image carrier 6 and the transferring section 10 to be a second conveying velocity which is slower than the first conveying velocity (step S7).

By slowing down the conveying velocity of the print medium S by the image carrier 6 and the transferring section 10, a period of time during which the print medium S, having the fixing solution applied thereto, passes the heater 23 can be made longer.

Therefore, in the case that the temperature T is lower than the threshold value T1, it is possible to secure a long period of time for fixing the toner image to the print medium S.

As a result, it is possible to suppress the lowering in the fixing property of the toner image with respect to the print medium S due to the temperature of the environment in which the image forming apparatus 1 is installed.

Note that the second conveying velocity is preferably in a range of not less than ¼ times to not more than ½ times the first conveying velocity.

Further, in the case that the temperature T is lower than the threshold value T1 (step S3: NO), the controller 25 controls the conveyor 21 so as to make the conveying velocity of the print medium S by the conveyor 21 to be a second velocity which is slower than the first velocity (step S8). It is preferred that the second velocity is a velocity which is same as the second conveying velocity.

By slowing down the conveying velocity of the print medium S by the conveyor 21, it is possible to make a period of time, since the fixing solution has been applied to the print medium and until the print medium S is discharged to the outside of the body casing 2, to be long.

With this, in the case that the temperature T is lower than the threshold value T1, it is possible to secure a long period of time for fixing the toner image to the print medium S.

Further, by slowing both the conveying velocity of the print medium S by the conveyor 21 and the conveying velocity of the print medium S by the image carrier 6 and the transferring section 10, it is possible to increase the period of time during which the print medium S having the fixing solution applied thereto passes the heater 23, while conveying the print medium S at a stable conveying velocity; and it is possible to increase the period of time, since the fixing solution has been applied to the print medium S and until the print medium S is discharged to the outside the body casing 2, to be long.

Further, in the case that the temperature T is lower than the threshold value T1 (step S3: NO), the controller 25 may control the heater 23 so as to make the heating temperature of the heater 23 to be a second heating temperature which is higher than the first heating temperature.

By making the heating temperature of the heater 23 to be high, it is possible to fix, in a more ensured manner, the toner image to the print medium S.

The second heating temperature is, for example, in a range of not less than 50° C. to not more than 150° C. The second heating temperature is preferably in a range of not less than 60° C. to not more than 80° C.

4. Effects

According to the image forming apparatus 1, in the case that the temperature T is lower than the threshold value T1 (step S3: NO) as depicted FIG. 3, the controller 25 controls the image carrier 6 and the transferring section 10 so as to make the conveying velocity of the print medium S by the image carrier 6 and the transferring section 10 to be the second conveying velocity which is slower than the first conveying velocity (step S7).

With this, it is possible to make the period of time during which the print medium S having the fixing solution applied thereto passes the heater 23.

Therefore, in the case that the temperature T is lower than the threshold value T1, it is possible to secure a long period of time for fixing the toner image to the print medium S.

As a result, it is possible to suppress the lowering in the fixing property of the toner image with respect to the print medium S due to the temperature of the environment in which the image forming apparatus 1 is installed.

Further, according to the image forming apparatus 1, as depicted in FIG. 3, in the case that the temperature T is lower than the threshold value T1 (step S3: NO), the controller 25 controls the conveyor 21 so as to make the conveying velocity of the print medium S by the conveyor 21 to be the second velocity which is slower than the first velocity (step S7).

With this, it is possible to make the period of time, since the fixing solution has been applied to the print medium S and until the print medium S is discharged to the outside of the body casing 2, to be long.

Therefore, in the case that the temperature T is lower than the threshold value T1, it is possible to secure a long period of time for fixing the toner image to the print medium S.

As a result, it is possible to suppress the lowering in the fixing property of the toner image with respect to the print medium S due to the temperature of the environment in which the image forming apparatus 1 is installed.

Further, according to the image forming apparatus 1, the controller 25 controls the heating temperature of the heater 23 in accordance with the application amount of the fixing solution to be applied by the fixing section 5. Specifically, in a case that the image quality of the toner image is a high image quality, the controller 25 controls the fixing section 5 so as to increase the application amount of the fixing solution, and the controller 25 controls the heater 23 so as to make the heating temperature of the heater 23 to be high. On the other hand, in a case that the image quality of the toner image is a low image quality, the controller 25 controls the fixing section 5 so as to reduce the application amount of the fixing solution, and the controller 25 controls the heater 23 so as to make the heating temperature of the heater 23 to be low.

Therefore, in the case that the image quality of the toner image is the high image quality, it is possible to secure a long period of time for fixing the toner image to the print medium S. On the other hand, in the case that the image quality of the toner image is the low image quality, it is possible to suppress the consumption of the fixing solution, and to suppress the consumption of electric power for heating the heater 23.

As a result, it is possible to suppress the lowering in the fixing property of the toner image with respect to the print medium S due to the temperature of the environment in which the image forming apparatus 1 is installed, and it is also possible to suppress the consumption amount of the fixing solution and to suppress the consumption amount of the electric power for heating the heater 23.

Further, according to the image forming apparatus 1, as depicted in FIG. 1, the temperature sensor 22 measures the temperature in the vicinity of the fixing section 5, more specifically, the temperature in the space between the transferring section 10 and the fixing section 5.

Therefore, it is possible to control the conveying velocity of the print medium S and the heating temperature of the heater 23, while monitoring the temperature in the vicinity of the fixing section 5.

5. Modifications

In the above-described embodiment, the controller 25 may control at least the conveying velocity of the print medium S by the image carrier 6 and the transferring section 10. Namely, the conveying velocity of the print medium S by the conveyor 21, and the heating temperature of the heater 23 may be constant.

Further, the controller 25 may control at least the conveying velocity of the print medium S by the conveyor 21. In such a case, the conveying velocity of the print medium S by the image carrier 6 and the transferring section 10 and the heating temperature of the heaters 23 may be constant.

What is claimed is:

1. An image forming apparatus comprising:

a body casing;

a toner image forming section configured to form a toner image onto a print medium, the toner image forming section including:

an image carrier; and a transferring section configured to transfer the toner image formed on a surface of the image carrier to the print medium, and convey the print medium together with the image carrier;

a fixing section configured to apply a fixing solution to the print medium conveyed by the image carrier and the transferring section such that the toner image is fixed onto the print medium;

a heater configured to heat the print medium having passed the fixing section;

a temperature sensor configured to measure a temperature in the body casing; and a controller configured to control the image carrier and the transferring section, wherein in a case that the temperature measured by the temperature sensor is higher than a predetermined threshold value, the controller is configured to;

control the image carrier and the transferring section such that a conveying velocity of the print medium by the image carrier and the transferring section becomes a first conveying velocity; and control the heater such that a heating temperature of the heater becomes a first heating temperature, and wherein in a case that the temperature measured by the temperature sensor is lower than the predetermined threshold value, the controller is configured to:

control the image carrier and the transferring section such that the conveying velocity of the print medium by the image carrier and the transferring section becomes a second conveying velocity slower than the first conveying velocity; and control the heater such that the heating temperature of the heater becomes a second heating temperature which is higher than the first heating temperature.

2. The image forming apparatus according to claim 1, wherein the temperature sensor is configured to measure a temperature in the vicinity of the fixing section.

3. The image forming apparatus according to claim 2, wherein the temperature sensor is configured to measure a temperature in a space between the transferring section and the fixing section.

4. The image forming apparatus according to claim 1, wherein the threshold value is in a range of not less than 0° C. to not more than 10° C.

5. The image forming apparatus according to claim 1, wherein the second conveying velocity is in a range of not less than 1/4 times to not more than 1/2 times the first conveying velocity.

6. The image recording apparatus according to claim 1, further comprising a conveyor configured to convey the print medium having passed the fixing section, wherein in the case that the temperature measured by the temperature sensor is higher than the predetermined threshold value, the controller is configured to control the conveyor such that a conveying velocity of the print medium by the conveyor becomes a first velocity; and in the case that the temperature measured by the temperature sensor is lower than the predetermined threshold value, the controller is configured to control the conveyor such that the conveying velocity of the print medium by the conveyor becomes a second velocity which is slower than the first velocity.

7. The image forming apparatus according to claim 6, wherein the heater is positioned between the fixing section and the conveyor.

8. The image forming apparatus according to claim 6, wherein the controller is configured to control an application amount of the fixing solution to be applied by the fixing section, in accordance with an image quality of the toner image, and the controller is configured to control the heating temperature of the heater in accordance with the application amount of the fixing solution to be applied by the fixing section.

9. The image forming apparatus according to claim 6, wherein the heater makes no contact with the print medium in a case that the heater heats the print medium.

10. The image forming apparatus according to claim 6, further comprising a driving source configured to drive the conveyor, wherein the driving source is configured to drive the image carrier and the transferring section.

11. An image forming apparatus comprising:

a body casing;

a toner image forming section configured to form a toner image onto a print medium;

a fixing section configured to apply a fixing solution to the print medium, having the toner image formed thereon by the toner image forming section, such that the toner image is fixed to the print medium;

a heater configured to heat the print medium which has passed the fixing section; and a controller, wherein the controller is configured to control an application amount of the fixing solution to be applied by the fixing section, in accordance with an image quality of the toner image, and the controller is configured to control a heating temperature of the heater in accordance with the application amount of the fixing solution to be applied by the fixing section.

12. An image forming apparatus comprising:

a body casing;

a toner image forming section configured to form a toner image onto a print medium;

a fixing section configured to apply a fixing solution to the print medium, having the toner image formed thereon by the toner image forming section, such that the toner image is fixed to the print medium;

a conveyor configured to convey the print medium having passed the fixing section;

a temperature sensor configured to measure a temperature in the body casing; and a controller configured to control the conveyor, wherein in a case that the temperature measured by the temperature sensor is higher than a predetermined threshold value, the controller is configured to:

control the conveyor such that a conveying velocity of the print medium by the conveyor becomes a first velocity; and control the heater such that a heating temperature of the heater becomes a first heating temperature, and wherein in a case that the temperature measured by the temperature sensor is lower than the predetermined threshold value, the controller is configured to:

control the conveyor such that the conveying velocity of the print medium by the conveyor becomes a second velocity slower than the first velocity; and control the heater such that the heating temperature of the heater becomes a second heating temperature which is higher than the first heating temperature.

* * * * *